United States Patent [19]

Ruby et al.

[11] Patent Number: 5,027,034

[45] Date of Patent: Jun. 25, 1991

[54] ALTERNATING CATHODE FLORESCENT LAMP DIMMER

[75] Inventors: Joseph H. Ruby, Glendale; Richard W. Steinke, Phoenix, both of Ariz.

[73] Assignee: Honeywell Inc., Minneapolis, Minn.

[21] Appl. No.: 420,333

[22] Filed: Oct. 12, 1989

[51] Int. Cl.[5] ..... H05B 41/36; H05B 41/38

[52] U.S. Cl. ..... 315/106; 315/98; 315/307; 315/DIG. 4; 315/DIG. 5

[58] Field of Search ..... 315/94, 98, 105, 106, 315/107, 291, 307, DIG. 4, DIG. 5

[56] References Cited

U.S. PATENT DOCUMENTS 4,394,603 7/1983 Widmayer ..... 315/105 X

*Primary Examiner*—David Mis

*Attorney, Agent, or Firm*—Haugen and Nikolai

[57] ABSTRACT

An apparatus for use in dimming florescent lamps by alternating cathodes operated with pulsating unidirectional arc currents for a duration that is long relative to the filament thermal time constant, but short in relation to the mercury migration time constant of the florescent lamp. The invention provides apparatus using full bridge switching and full bridge clamping topology in a trigger driver as well as a power driver to prevent low voltage power supply "ride up". The invention further provides means for sensing cathode heater current to detect a failed cathode and to control the phase switching to a good cathode if a cathode failure occurs. The invention further provides apparatus for a balanced-to-group ground lamp drive voltage for improved ignition of the lamp plasma and better lamp luminance uniformity when the lamp is operated dimly. A logarithmic amplifier is provided in a closed loop operation for analog compression and also to provide a logarithmic dimming response. Flash protection is provided in order to eliminate pilot distractions.

15 Claims, 4 Drawing Sheets

ALTERNATING CATHODE FLORESCENT LAMP DIMMER

FIELD OF THE INVENTION

The invention is directed generally to apparatus for use in dimming fluorescent lamps and, more particularly, to a high efficiency circuit having a large dimming range ratio suitable for use in application such as flat panel displays where ambient light may change from very dim to very bright as, for example, in an aircraft environment.

BACKGROUND OF THE INVENTION

Aircraft flat panel displays presently under development have extremely high theoretical thermal stresses. Presently known back light dimmers require as much as 10 watts to provide proper luminance for an aircraft environment. Ten watts is nearly half of a typical total display unit power demand. Therefore, any significant decrease in the backlight power requirements would also significantly reduce the display unit thermal stress. Assignee's co-pending application Ser. No. 07/280,482, filed Dec. 6, 1988 entitled "Fluorescent Lamp Dimmer" teaches a fluorescent lamp dimming system using high frequency pulsating AC with two independent power control variables for dimming, namely pulse width and pulse frequency. As taught in Ser. No. 07/280,482, multiple lamps are driven in order to provide single failure redundancy. Such an approach requires excessive power, but helps to create some redundancy in order to avoid catastrophic failure such as a dark display. The teachings of Ser. No. 07/280,482 are incorporated herein by this reference in their entirety. Since such a multiple lamp approach requires at least two fluorescent lamps in each display, if one lamp fails, the other lamp will provide some luminance for a useable display. Since an AC lamp drive is used, power must be applied to the heater electrodes at each end of each lamp for a total of four heaters. The heater power produces no useable light. In addition, the power lost in the cathode fall in each lamp provides no light. Therefore, while the Ser. No. 07/280,482 application has certain advantages over the prior art, certain of its features are inefficient when compared to the invention disclosed herein.

For example, matching luminance between multiple lamps over the complete dimming range and over a wide ambient temperature range is very difficult to achieve with the system as disclosed in Ser. No. 07/280,482. A luminance mismatch between lamps or along a lamp creates a luminance nonuniformity over the surface of the display. Further, lamp cathodes used in such an AC system were made small in order to conserve power. Unfortunately, this contributes to a very short lamp life. The new apparatus disclosed herein consumes significantly less power than the AC system and does not require matching luminance.

The present invention provides a fluorescent lamp dimmer which drives only one cathode at a time with pulsed DC energy. The pulsed DC drive energy is switched to the other cathode before any significant mercury migration can take place within the lamp. Other DC drive techniques inherently have problems with mercury migration because they do not alternate drive currents from one cathode to the other so as to avoid mercury migration. Other DC lamp drives only heat one cathode, but after about 30 minutes, depending upon lamp size and lamp temperature, a mercury migration occurs inside the fluorescent lamp that causes a significant luminance variation along the lamp. It may also cause lamp ignition problems when the lamp is required to be very dim. In addition, a change in lamp color from white to pink along the lamp may occur due to lack of local mercury vapor pressure within a DC driven lamp. The present invention allows significant power savings for the same light output, provides cathode redundancy with a single more efficient lamp, and solves the mercury migration problem of other DC drive techniques.

The invention is particularly useful for flat panel aircraft displays which present a two-fold problem. The first problem requires finding a solution for reducing power while maintaining the same luminance flux. The second problem relates to maintaining redundancy so that a single lamp failure will not be catastrophic and result in an unusable display. With the DC lamp driver discussed above, only one end or filament of a lamp is emitting electrons. Therefore, only the emitting end must be heated to thermionic emission temperature with filament heater power. When using an AC drive, the arc current will alternate in direction at a 60 Hz to 16 KHz rate. Since the thermal time constant of the filament heater is relatively long (i.e., several seconds, compared to the switching periods) the AC system must simultaneously heat both filaments to thermionic emission temperature. Therefore, both filaments are behaving as cathodes and both cathodes are required for the lamp to operate normally.

It is also desirable to use only one longer lamp instead of two lamps to further reduce power loss by limiting the loss to only one cathode fall instead of the usual two. Until the present invention, redundancy for reliability required two lamps. A major failure mechanism in a fluorescent lamp of the type used in flat panel displays is cathode failure. If a single lamp were used with either of the AC or DC drive systems described above, and a single cathode were to fail, the lamp would be catastrophically dark in the DC drive case and dim and flicker badly in the AC drive case.

The fluorescent lamp dimmer as provided in accordance with the present invention solves these problems by allowing the use of one longer lamp while driving and heating only one cathode at a time. The drive is switched to the other cathode before mercury migration can take place. Typically, mercury migration takes place in about 30 minutes. If a cathode failure is detected, the switching done in accordance with the present invention will not occur, thus, providing an immunity to a single cathode failure resulting in a catastrophic failure. Instead, the lamp will dim normally with the single failure and without flicker. Some luminance variation due to mercury migration will occur until the failed lamp can be replaced, but the display will be usable. In addition, very significant power savings are achieved by apparatus provided in accordance with the present invention because instead of the heating loss in four cathodes and the power loss in two cathode falls, the apparatus of the invention can drive a single longer lamp and produce the same luminance flux from the positive column arc while only requiring one filament to be heated. Thus, power loss in only one cathode fall is experienced.

In one particular example of the types of lamps being used for an aircraft flat panel display, each filament heater requires one watt and the power loss in the dark cathode fall region is about 0.75 watts. Thus, if an AC or DC system other than the present invention is used which requires two lamps for a single failure reliability, the power required for driving the lamps, excluding the light producing positive column arc power totals as follows:

| Description = | Watts |
|---|---|
| Four filament heaters at one watt = | 4.0 watts |
| Two cathode falls at 0.75 watts each = | 1.5 watts |
| Total = | 5.5 watts |

This power produces no light. Light output only comes from the positive column arc power of 4.5 watts which is the same for the present invention as the other AC and DC techniques described above. For the new technique, the power required to drive the lamp totals as follows.

| | |
|---|---|
| 1 Filament Heater = | 1.0 Watts |
| 1 Cathode Fall = | 0.75 Watts |
| Total | 1.75 Watts |

This power produces no light, but is 3.75 watts lower than the other techniques. Thus, the present invention, as used in this example, would save 3.75 watts out of a total of 10 watts as originally required.

SUMMARY OF THE INVENTION

The apparatus in accordance with the present invention saves significant drive power through arranging florescent lamp dimmer circuit topology so as to require only one filament at a time to be heated. Instead of operating the lamp on DC, which has mercury migration related luminance variation and light color problems or on AC which requires both filaments of each lamp to be heated simultaneously, the lamp is operated with a pulsating unidirectional arc current for a duration that is long relative to the filament thermal time constant, but short in relation to the mercury migration time constant. At the end of the operational time period, the heat is switched to the other filament and the pulsating unidirectional arc current is forced to flow in the other direction, thus using the other end of the lamp as the cathode. This process then repeats. In one example, the net result of the technique as provided by the present invention is to allow a decrease in lamp drive power from 10 watts to 6.25 watts, a 38% power reduction. Such a reduction in power is very desirable because it reduces thermal stress on all components in a flat panel display. In addition, it provides cathode redundancy and single failure operation using a more efficient longer positive column of a single lamp. In systems where power is not at such a premium, lamp life can be extended by using larger cathodes and still not consume as much heat or power as other schemes.

It is one object of the invention to provide a fluorescent lamp dimming apparatus which alternately drives only one cathode at a time in a fluorescent lamp having two filaments, each of which may act as a cathode when driven by the arc current.

It is another object of the invention to use a full bridge switching and a full bridge clamping topology in a trigger driver as well as a power driver to prevent low voltage power supply "ride up".

It is yet another object of the invention to detect a failed cathode by sensing cathode heater current and to control the phase switching to the good cathode if there is a cathode failure.

It is yet another object of the invention to provide a balanced-to-ground lamp drive voltage for improved ignition of the lamp plasma and better lamp luminance uniformity when the lamp is dim.

It is yet a further object of the invention to provide closed loop operation through a logarithmic amplifier for analog compression and to provide a logarithmic dimming response.

It is yet another object of the invention to provide an alternating cathode fluorescent lamp dimmer which includes flash protection to eliminate pilot distractions due to flashing displays.

DESCRIPTION OF THE PREFERRED EMBODIMENT

Figure 1A:
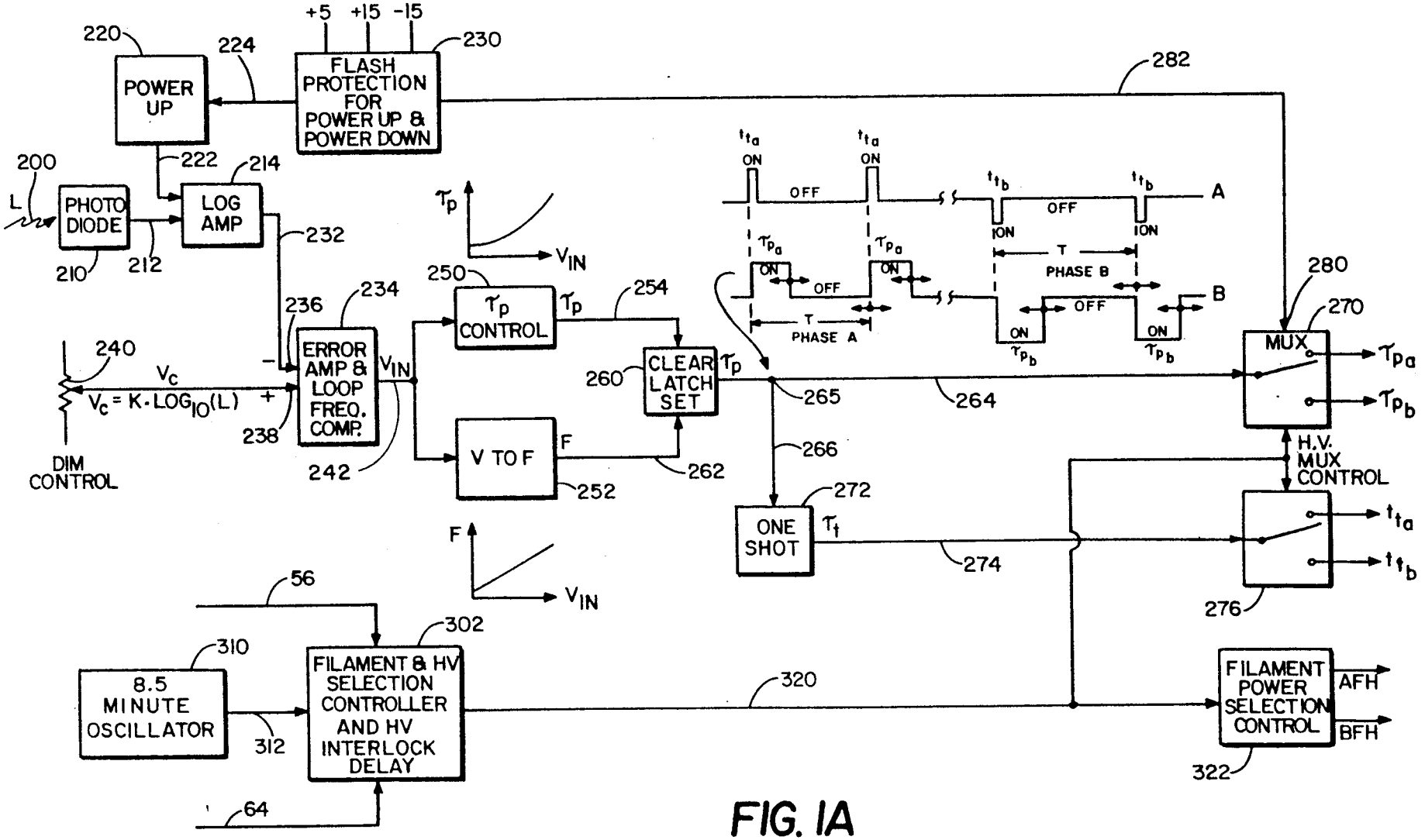
FIGS. 1A and 1B are block diagrams each illustrating a portion of an alternating cathode dimming apparatus in accordance with the present invention.
Figure 1B:
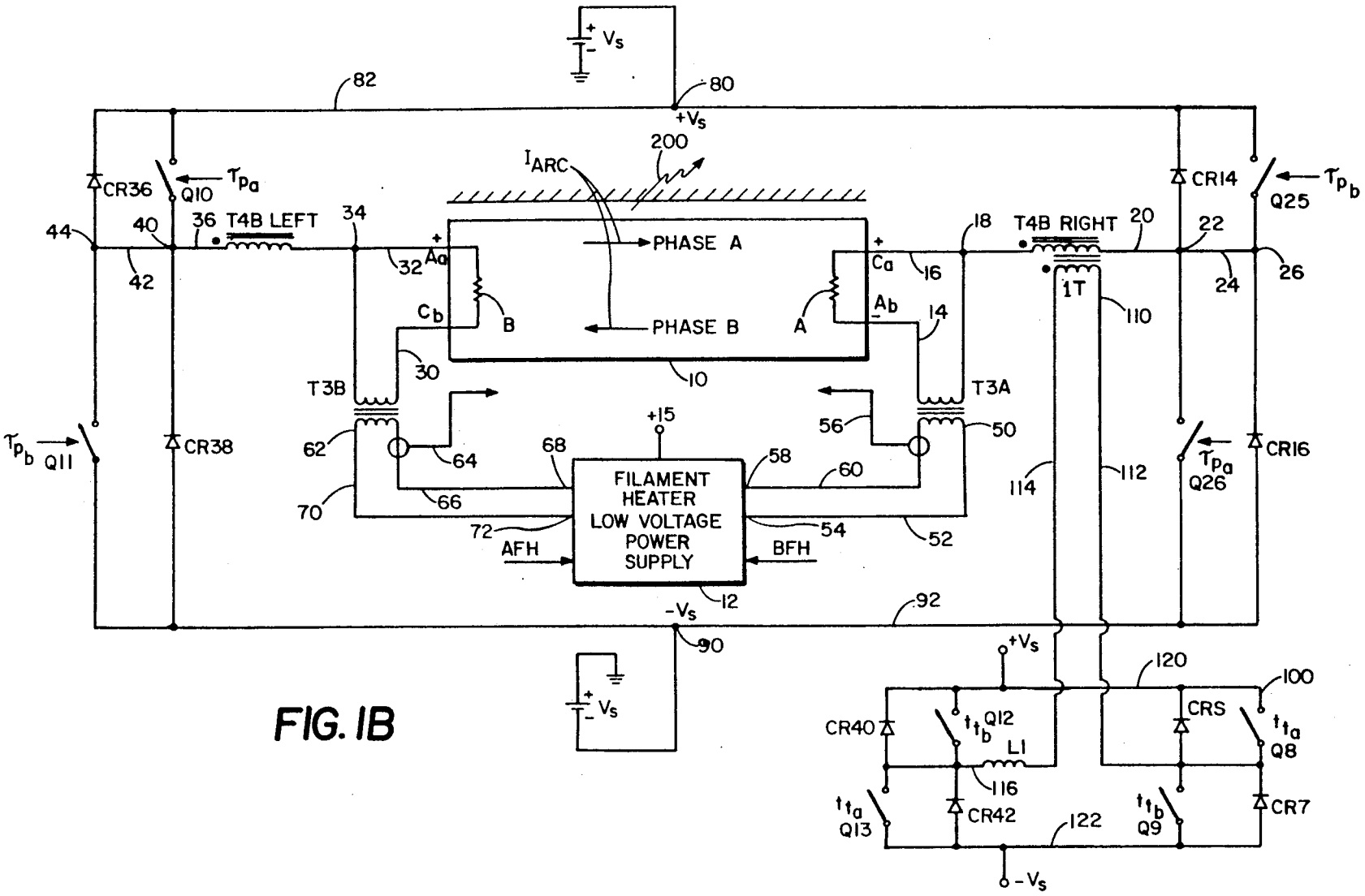

Referring now to FIGS. 1A and 1B, a block diagram of an apparatus for providing alternating cathode fluorescent lamp dimming in accordance with the present invention is shown. Some of the features incorporated into the present invention are already described in assignee's co-pending application Ser. No. 07/280,482 as described hereinabove and incorporated herein by reference. In the co-pending application two independent power control parameters are varied to obtain a large dynamic range of lamp dimming. The operation of the main transformer and trigger choke are described in the co-pending application as well as the closed loop operation utilized in the present invention. Dynamic lamp characteristics as a function of dimming are also described in the co-pending application. Therefore, the detailed description which follows below will be confined to differences between the co-pending application and the alternating cathode technique as provided in accordance with the present invention. In particular, but not by way of limitation, the present invention provides new apparatus for alternately driving only one cathode at a time with cathode heat and cathode arc current, to reduce power consumption and to increase cathode life by reducing cathode evaporation. Further, the present invention provides for the first time apparatus using a full bridge switching and a full bridge clamping topology in the trigger driver as well as the power driver to prevent low voltage power supply "ride up". Further, the present invention provides means for sensing cathode heater current to detect a failed cathode and to control the phase switching to a good cathode if a cathode failure occurs. Further still, the present invention provides apparatus for a balanced-to-ground lamp drive voltage for improved ignition of the lamp plasma and better lamp luminance uniformity when the lamp is operated dimly. Further still, the present invention provides closed loop operation through a logarithmic amplifier for analog compression and also to provide a logarithmic dimming response. Further still, the present invention provides flash protection in order to eliminate pilot distractions. Referring specifically to FIG. 1B a lamp 10 is shown having a first filament A and a second filament B. A first end of filament A is connected by conductor 14 to one terminal of a first winding of transformer T3A. The other end of filament A is connected by conductor 16 to node 18 which electrically connects the other end of the first winding of T3A and one side of transformer T4B's right secondary winding. The other end of T4B's right secondary winding is connected by conductor 20 to node 22. Also connected to node 22 is the anode of diode CR14 and one pole of semiconductor switch Q26. Node 22 is further connected by conductor 24 to node 26 which is also connected to the cathode of diode CR16 and a first pole of semiconductor switch Q25.

Filament B has a first terminal connected by conductor 30 to a first terminal of a first winding of transformer T3B. A second terminal of filament B is connected by conductor 32 to node 34 which is further connected to a second terminal of the first winding of transformer T3B and a first terminal of transformer T4B's left secondary winding. A second terminal of T4B's left secondary winding is connected by conductor 36 to node 40 which is also connected to a cathode of diode CR38 and one pole of semiconductor switch Q10. Node 40 is further connected by conductor 42 to node 44. Node 44 is electrically connected to the anode side of diode CR36 and one pole of semiconductor switch Q11. A second winding 50 of transformer T3A has a first terminal connected by conductor 52 to port 54 of circuit 12, a filament heater low voltage power supply which is explained further in detail below. The second terminal of winding 50 is connected to current sense line 56 and also to port 58 of circuit 12 by conductor 60.

The second winding 62 of transformer T3B has a first terminal connected to current sense line 64 and a further connection by conductor 66 to port 68 of circuit 12. A second terminal of winding 62 is connected by conductor 70 to a port 72 of circuit 12. The full bridge power drive circuit as employed by the invention further has a power rail with a voltage of $+V_s$ at node 80 connected to conductor 82 which is further connected to the cathode of diode CR36, a second pole of semiconductor switch Q10, the cathode of diode CR14 and a second pole of semiconductor switch Q25. The opposite end of the power drive at node 90 remains at a voltage $-V_s$ which is connected to conductor 92. Conductor 92 further electrically connects a second pole of semiconductor switch Q11, the anode of diode CR38, a second pole of semiconductor switch Q26 and the anode of diode CR16.

A full bridge trigger drive circuit 100 includes a winding 110 coupled to T4B right and having a first terminal connected by conductor 112 to the anode of CR5, one pole of semiconductor switch Q8, the cathode of diode CR7 and one pole of semiconductor switch Q9. A second terminal of winding 110 is connected by conductor 114 to one side of inductor L1, which is also part of transformer T4A. The second terminal of inductor L1 is connected by conductor 116 to one pole of semiconductor switch Q12, the cathode diode CR42, the anode of diode CR40 and a first pole of semiconductor switch Q13. The power line 120 is also maintained at a voltage $+V_s$ and is connected to the cathode of CR40, a second pole of semiconductor switch Q12, the cathode of diode CR5 and a second pole of semiconductor switch Q8. Power line 122 is maintained at a $-V_s$ voltage and is connected to a second pole of semiconductor switch Q13, the anode of diode CR42, a second pole of semiconductor switch Q9 and the anode of diode CR7. A typical magnitude for voltage $V_s$ is about 125 volts.

Referring now to FIG. 1A, lamp luminance 200 impinges on photo diodes CR27 and CR28 which are included in photo diode circuit 210. The output of circuit 21 is connected by conductor 212 to a first input of logarithmic amplifier 214. Power up circuit 220 is connected to a second input of logarithmic amplifier circuit 214 by conductor 222. Power up circuit 220 is also connected by conductor 224 to a flash protection circuit 230.

Logarithmic amplifier circuit 214 is connected by conductor 232 to a first input 236 of error amp and loop frequency compensation circuit 234. A second input 238 of circuit 234 is connected to dim control 240. An output of circuit 234 is connected by conductor 242 to an input of circuit control 250 and also to an input of voltage to frequency circuit 252. An output of control circuit 250 is connected by conductor 254 to a "clear" input of latch 260. An output of circuit 252 is connected to the "set" input of latch 260 by conductor 262. An output of latch circuit 260 is electrically connected by conductor 264 to a first input of multiplexer 270 and by conductor 266 to an input of one shot circuit 272. An output of one shot 272 is connected by conductor 274 to a first input of multiplexer 276. Multiplexer 270 has a control input 280 which is connected by conductor 282 to flash protection circuit 230. Filament A heater current sense line 56 is connected to a first input of filament and high voltage selection controller and high voltage interlock delay circuit 302. Filament B heater current sense line 64 is connected to a second input of circuit 302. Oscillator 310 is connected by conductor 312 to filament circuit 302. An output of filament circuit 302 is connected by conductor 320 to high voltage multiplexer control lines for multiplexers 270 and 276 and to an input of filament power selection control circuit 322. Multiplexer 270 has a first output $\tau_{Pa}$ and a second output $\tau_{Pb}$. Multiplexer 276 has a first input $t_{ta}$ and $t_{tb}$. Filament power selection control circuit 322 has a first output AFH and a second output BFH.

OPERATION OF THE INVENTION

Having described with specificity the elements of one embodiment of the invention, the operation of the invention will now be described in order to promote a better understanding of the principles of the invention. Referring again to FIGS. 1A and 1B, note that the lamp 10 has two filaments A and B. The filament heater low voltage power supply 12 is controlled to heat either filament A or B or both by control signals AFH or BFH from filament power selection control circuit 322. When filament A is heated, it must be used as the cathode and, thus, arc current $I_{ARC}$ flows from filament B, serving as the anode to filament A, acting as the cathode. Those skilled in the art will note that this is the positive current direction. Electron current is in the opposite direction. As used herein, the definition of a cathode requires that the cathode be the element in a system that emits electrons. The direction of the arc current $I_{ARC}$ is controlled by the switching polarity of the high voltage applied across the ends of the lamp. The high voltage pulse is composed of two parts, namely, a trigger pulse $t_t$, and a power pulse $\tau_p$. Both phase A and phase B have related trigger pulses and power pulses. As used herein, phase A refers to the mode in which the A filament operates as a cathode. Conversely, phase B refers to the mode in which filament B operates as a cathode. During the relatively long duration of phase A operation, about 8.5 minutes, the pulses used are trigger pulses $t_{ta}$ and power pulse $\tau_{Pa}$. The trigger pulse, $t_{ta}$ graphs A and B located above node 265 in FIG. 1A show the timing relationships between the trigger pulses and power pulses. The trigger pulse is a constant 1.2 microseconds in duration and closes switches Q8 and Q13 for this duration. Trigger current is drawn from the positive power supply $+V_s$ through Q8, the undotted primary of transformer T4B, inductor L1, semiconductor switch Q13 and into the negative supply rail $-V_s$. Switching in this manner results in full bridge switching which draws the same current from the $+V_s$ power rail as it does from the $-V_s$ power rail, loading each power supply equally. The polarity of the transformer T4B trigger windings are such that for phase A operation, filament A is driven negatively with respect to ground and filament B is driven positively by the same amount with respect to ground. At the same time as the trigger switches Q8 and Q13 close, the power pulse $\tau_{Pa}$ closes power switches Q10 and Q26. In this manner, $+V_s$ is provided at the dotted end of the left half of transformer T4B's secondary winding and $-V_s$ at the undotted end of the right half of T4B's secondary winding. During the trigger duration, an additive voltage is, thus, provided such that each end of the lamp reaches an even higher voltage by an amount equal to the magnitude of voltage $V_s$ referenced to ground. Further, the voltage relative to ground at each end of the lamp is balanced. This is due to the split secondary of transformer of T4B shown as T4B LEFT and T4B RIGHT.

In one example of a florescent lamp dimmer incorporating the principles of the invention, in a mode when the lamp is dim, and transformer T4B right and left secondary windings have a 7-to-1 turns ratio between each secondary and the primary, and where $V_s$ equals 125 volts, +1000 volts will be obtained at filament B relative to ground and −1000 volts will be obtained at filament A relative to ground. The resultant end-to-end lamp voltage will be 2000 volts. The aforedescribed balance-to-ground drive circuitry improves lamp ignition and luminance uniformity when the lamp is dim. Further, this circuitry minimizes the luminance transient that may occur when switching between phases A and B every 8.5 minutes.

After 1.2 microseconds the trigger switches open but the power switches remain closed. As in the 07/280,482 patent application, $\tau_p$ is a variable pulse width that varies from 1.0 microseconds to 38.5 microseconds. Two events immediately follow the end of the 1.2 microsecond trigger time period. First the excess trigger energy stored in the trigger choke L1 but not required by the lamp, is returned to both the $+V_s$ and $-V_s$ power supplies through diode CR40 and CR7. In this way, the return current to the $+V_s$ supply is the same as the returned current to the $-V_s$. Diode CR40 and CR7 also operate as clamping diodes to prevent high voltage damage to the switching FETs. Since there is always more energy drawn from each supply than is returned and since the current return to each supply is equal, the power supplies cannot ride up as they would with the circuitry taught in Ser. No. 07/280,482. In the co-pending patent application, if the alternating cathode approach of the present invention were attempted, one of the 125 volt $V_s$ supplies would "ride up" to more than 250 volts. This would result in a failure of the low voltage power supply unit. The employment of full bridge switching and full bridge clamping for both the trigger and the power systems in the present invention solves the "ride up" problem. The second event is the initialization of the main power pulse current ramp. During the time in which the trigger pulse is on, the lamp plasma is ionized by the high lamp end-to-end voltage and the arc through the lamp is started. With the lamp ionization process started, the lamp voltage falls to a low voltage near 75 volts and enters a negative resistance region wherein the lamp current increases as the lamp end-to-end voltage drops further. When the trigger energy is dissipated, the main lamp current is controlled by the end-to-end inductance of transformer T4B's secondaries, the $V_s$ supplies and the lamp voltage. In one example embodiment of the invention, the inductance of the T4B secondaries is about 44 mh.

Figure 2:
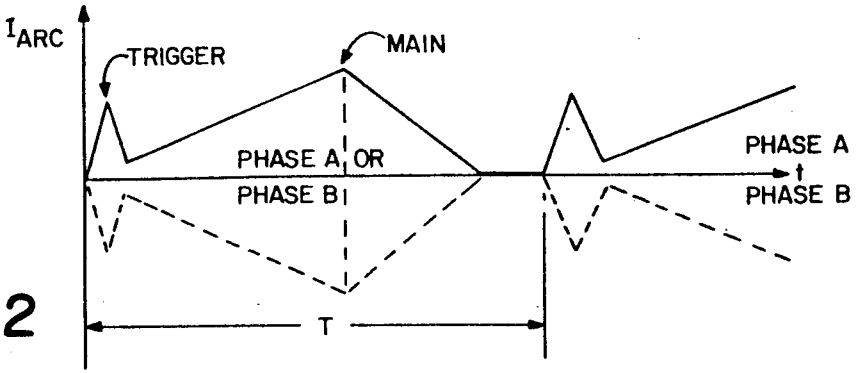
FIG. 2 is a graph which illustrates the arc current as controlled in accordance with the teachings of the present invention.

The main lamp current path for phase A comes from the $+V_s$ supply switch Q10, transformer T4B's left secondary winding, the lamp, transformer T4B right secondary winding, switch Q26, and into the $-V_s$ supply. Since the lamp voltage when the lamp is bright is less than $2V_s$, the lamp current ramps up as shown for phase A in FIG. 2. At the peak of this main current, $\tau_{Pa}$ ends and switches Q10 and Q26 turn off. The excess energy stored in the secondary inductance of transformer T4B which is not required by the lamp is returned to the power supplies through diodes CR38 and CR14. Those skilled in the art will recognize that the excess energy is really stored in the core air gap of transformer T4B windings. Thus, due to the full bridge switching and the full bridge clamping operation of the apparatus of the invention, equal currents are drawn from the $+V_s$ and the $-V_s$ supplies as well as equal currents returned to the $+V_s$ and $-V_s$ supplies. Therefore, there is again no power supply "ride up". This is true over the dimming range of 2000 to 1 as required by certain aircraft flat panel display systems. It is also important to note that the complete current wave form flows in only one direction through the lamp, thereby requiring only filament A to emit electrons. Filament B acts only as the anode and requires no heating power during the 8.5 minutes of phase A operation. At the end of period T as shown in Graph B in FIG. 1A and again in FIG. 2, phase A trigger and power pulses repeat. This phase A sequence continues to repeat for 8.5 minutes. After 8.5 minutes, phase B begins. Phase B uses the opposite switches and clamp diodes in each bridge in the same manner, and creates an arc current in the opposite direction through the lamp using filament B as the heated cathode and filament A as the unheated anode.

Referring again to FIG. 1A of the blocked diagram of a fluorescent lamp dimming apparatus in accordance with the present invention, it will be noted that the following elements are used and described in patent application 07/280,482 which is assigned to the same assignee as the present invention. These elements are the power up initial condition generator 220, photo diode circuit 210, error amplifier and loop frequency compensation circuit 234, $\tau_p$ control circuit 250, voltage to frequency converter 252, one shot circuit 272, dim control 240 and latch unit 260. Since the operation of these components is the same as in the referenced patent application and since they are described in detail in that application, they will not be further described herein.

A logarithmic amplifier 214 is not found in the co-pending application, but it is considered standard engineering design practice to analyze and frequency compensate the feedback loop through the logarithmic amplifier. The logarithmic amplifier provides analog compression similar to that provided by the gamma generator 28 shown in FIG. 1 of assignee's co-pending application so as to provide dimming command voltage $V_c$ which is logarithmically related to the lamp luminance as expressed by the formula $V_c = K^* \log_{10}(L)$. The closed loop operation of the present invention is similar to that of co-pending application Ser. No. 07/280,482.

Flash protection circuitry 230 eliminates any "bright" flashes of light during power up or power down transition. The term "bright" is relative because a very small amount of energy could cause a "bright" flash during night flight when the pilots eyes are adapted to the dark. The flash protection circuit 230 monitors the +15, −15, and +5 volt supply voltages and controls initial conditions on the energy storage elements within the logarithmic amplifier and the error amplifier as well as operating to inhibit the high voltage pulses. In this way, the flash protection circuit does not allow the lamp luminance to exceed the commanded luminance during power transients. Such flash protection is understood to be standard engineering design practice.

Still referring to FIG. 1A, multiplexer 270, 276 and 322 provide various outputs. Multiplexer 270 provides power pulse multiplexing for $\tau_{Pa}$ and $\tau_{Pb}$. Multiplexer 276 provides triggering pulse multiplexing for $t_{ta}$ and $t_{tb}$. Multiplexer 322 provides filament heater multiplexing for phase A and phase B heater power. As shown in FIG. 1B, these multiplexer select via the control signals $\tau_{Pa}$, $\tau_{Pb}$, $t_{ta}$ and $t_{tb}$ which semiconductor switches are operated for phase A or phase B. For phase A, the trigger $t_{ta}$, the power pulse $\tau_{Pa}$ and the A filament heater are active. The opposite is true for phase B operation. The three multiplexers are controlled by the logic signals from the filament and high voltage selection controller and high voltage interlock delay circuit 302. Filament circuit 302 has first, second and third inputs for the 8.5 minute oscillator, filament A heater current sensor and filament B heater current sensor respectively. Using these three inputs, the filament circuit 302 controls the heater power to both filament A and filament B as well as controlling the trigger and power switches for phase A or phase B.

Logic circuitry is implemented within filament selection circuit 302 to turn filament power on to both filament A as well as filament B during the initial power application to the backlight unit. Due to an intentional mismatch of time constants, the current sense detector will show filament A warmed up first, assuming that filament A has not failed. This is explained further below with reference to a more detailed description of circuit 302. Once filament A is warm, phase A is selected by the first, second and third multiplexers, phase A high voltage pulses are enabled, and the heater power to filament B is turned off. The system is now operating in phase A. Dimming is controlled by a closed loop similar to that used in the co-pending application Ser. No. 07/280,482 with the addition of the use of the logarithmic amplifier 214. At the end of the 8.5 minute oscillator time period, filament B heater power is turned on. When the filament B heater current is detected by the current sense line and after an additional 4.0 second delay has elapsed, the high voltage multiplexer switches from phase A to phase B. This switching is synchronized with the output of the voltage-to-frequency converter 252 so as to allow the high voltage switching to take place only during a time period when the lamp arc current is zero. At this same time, the heater power to filament A is turned off and filament A cools down. The system is now operating in phase B. This sequence repeats every 8.5 minutes. If a cathode fails, its heater current will fall to 0 and be detected by the current sense line. The high voltage will be shut off and the signal command transmitted to turn on the power to both filament heaters. Since only one heater is good, it will conduct current and be detected via the current sensors. Once it is warm, the high voltage multiplexer will switch to that phase and then the high voltage pulses will be enabled, thus, operating normally in the space. At the end of 8.5 minutes, the current sense could not detect current in the failed cathode, thus no phase switching will take place and the same phase will continue to operate. Dimming operation would be normal but with mercury migration now unavoidably taking place. However, the display system is still useable in this operational mode. In most aircraft systems, if fault detection is built in, the failed lamp would be detected and replaced at the end of a flight. The logic for switching from phase A to phase B and back is a sequential logic circuit, the implementation of which is considered to be standard engineering design practice.

Figure 3B:
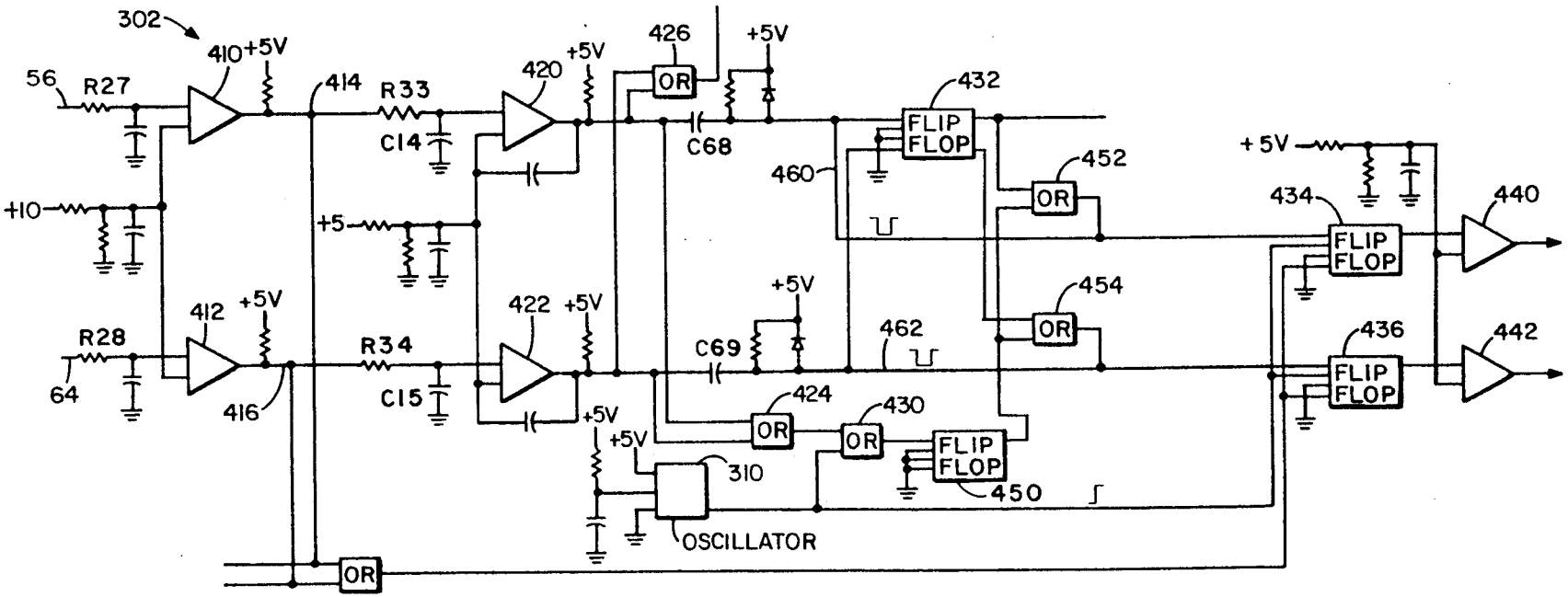
FIGS. 3A and 3B are intended to be joined together as a schematic illustration of one embodiment of a backlight dimmer apparatus as provided in accordance with the present invention.
Figure 3A:
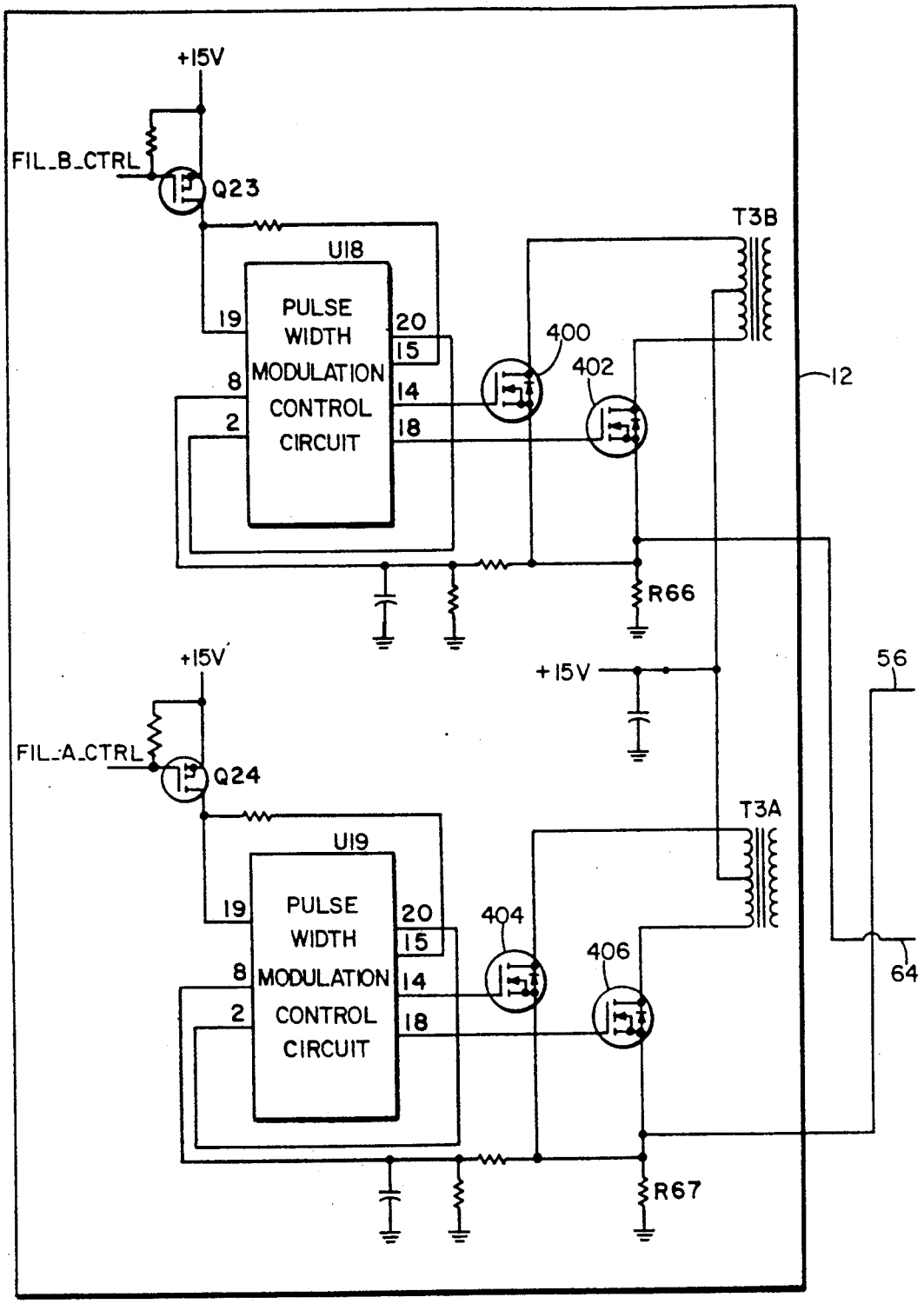

Now referring to FIGS. 3A and 3B, a more detailed schematic of one example embodiment as fabricated by Honeywell Inc., Commercial Avionic Systems Division, Phoenix, Ariz. is shown. Filament heater low voltage power supply 12 comprises pulse width modulation control circuits U18 and U19. Pulse width modulation control circuit U18 is configured to operate at a frequency of 55 Khz and pulse width modulation control circuit U19 is configured to oscillate at 50 Khz. Pulse width modulation control circuit U18 is activated through control signal FIL_B_CTRL through FET Q23. FIL_B_CTRL is the same line as BFH shown in FIGS. 1A and 1B. Similarly, pulse width modulation control circuit U19 which corresponds to filament A, operates responsively to control signal FIL_A_CTRL through FET Q24. FIL_A_CTRL is the same line as AFH shown in FIGS. 1A and 1B. A first output of U18 is electrically connected to the gate of FET 400 which is further connected to transformer T3B. A second output of U18, at pin 18 is connected to the gate of FET 402 which is connected at its drain to the other side of transformer T3B. Current in the B filament is sensed through sensing resistor R66 on line 64. Circuit U19 is similarly connected to FETs 404 and 406 and current in filament is sensed through sensing resistor R67 on line 50. Line 56 is electrically connected through R27 to comparator 410. Line 64 is connected through resistor R28 to the non-inverting input of comparator 412. The inverting inputs of comparators 410 and 412 are connected together. The output of comparator 410 signals that the A filament is on when node 414 goes high. Similarly, the output of comparator 412 signals that the B filament is on when node 416 exhibits a logical high. Resistor R33 is connected to node 414 at a first terminal and to capacitor C14 and the inverting input of comparator 420 at a second terminal. Similarly, resistor R34 is connected to node 416 at first terminal and capacitor C15 and the non-inverting input of comparator 422. The non-inverting inputs of comparators 420 and 422 are connected together. Elements R33 and C14 present a time constant to the circuit during initial power application to the lamp circuitry. R33 and C14, and R34 and C15 have intentionally mismatched time constants. In this example, R33 and C14 are selected to have a warmup time constant of 3.75 seconds for filament A while R34 and C15 are selected to have a warmup time constant of 4.55 seconds for filament B. This assures that cycling will always begin with phase A if filament A is operational. The output of comparator 420 is connected to one terminal of capacitor C68 and a first input of OR gate 424 as well as a first input of OR gate 426. The output of comparator 422 is connected to a second input of OR gates 426 and 424 as well as a first terminal of capacitor C69. The output of OR gate 424 is connected to a first input of OR gate 430, a second terminal of capacitor C68 is connected to a first input of flip flop 432 and to a first input of flip flop 434. Oscillator 310 has an output connected to a second input of OR gate 430 and second inputs of flip flops 434 and 436. The second terminal of capacitor C69 is connected to a first input of flip flop 436. Comparators 440 and 442 have non inverting inputs connected to the outputs of flip flops 434 and 436 respectively. The output of OR gate 430 is connected to flip flop 450. The output of flip flop 450 is connected to first inputs of OR gates 452 and 454. When the output of flip flop 450 is a logical High, it is a signal that both filaments are stuck on. The output of oscillator 310 causes a switching of the filament heat control upon presenting a leading edge as shown in the small graph above the oscillator output line. A signal on line 460 operates to turn filament B off upon creating a negative going pulse as shown in the small graph above line 460. Control line 462 causes filament A to turn off upon providing a negative going pulse as shown in the small graph above line 462.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Apparatus for dimming a florescent lamp having first and second filaments comprising:

(a) first means for sensing current in the first filament;

(b) second means for sensing current in the second filament;

(c) means for measuring a predetermined period of elapsed time;

(d) means for selecting the filaments to be heated responsive to the first and second current sense means and the time period measurement means so as to alternately switch between filaments;

(e) means for heating the selected filament responsive to the selection means;

(f) means for providing a full bridge power drive alternately to one of said first or second filaments in response to the selection means; and (g) means for providing a full bridge trigger drive alternately to one of said first or second filaments in response to the selection means.

2. The apparatus of claim 1 wherein the predetermined time period is less than the mercury migration time period of the lamp.

3. The apparatus of claim 1 wherein the predetermined time period is approximately 8.5 minutes.

4. The apparatus of claim 1 wherein the selection means further operates in response to the first and second current sensing means so as to only select an operational filament regardless of the time period.

5. The apparatus of claim 1 wherein the full bridge trigger drive provides a trigger pulse having a duration of about 1.2 microseconds.

6. The apparatus of claim 1 wherein the full bridge power drive provides a power pulse in the range of about 1.0 to 38.5 microseconds.

7. The apparatus of claim 1 wherein the range of dimming is 2000 to 1.

8. The apparatus of claim 1 further including means for preventing sporadic flashing.

9. Apparatus for dimming a florescent lamp having first and second filaments, each having a heater current when heated, comprising:

(a) a filament and high voltage selection controller means which outputs control signals;

(b) a first current sensor means adapted to sense the heater current in the first filament and present a first current sense signal to the selection controller;

(c) a second current sensor means adapted to sense the heater current in the second filament and present a second current sense signal to the selection controller;

(d) an oscillator means which presents an elapsed timed switching signal to the selection controller;

(e) a high voltage power pulse and trigger pulse control driver means responsive to the control signals from the selection controller so as to drive a selected filament;

(f) a filament power selection control means responsive to the control signal so as to alternately select one of the first or second filaments; and (g) a filament heater means responsive to the filament power selection control so as to heat the selected filament.

10. The apparatus of claim 9 wherein a failed filament is determined according to a predetermined current sense criteria and the filament power selection control means responds to the first and second current sense signals so as to select both filaments for heating if on filament has failed.

11. The apparatus of claim 10 wherein the elapsed time switching signal occurs within a time period less than the mercury migration period of the lamp as measured from the time heat is applied to one of the filaments.

12. The apparatus of claim 11 wherein the mercury migration period is greater than 30 minutes.

13. The apparatus of claim 12 wherein the high voltage power pulse and trigger pulse control driver means provides trigger pulses for the first and second filaments alternately having a pulse period of about 1.2 microseconds each.

14. The apparatus of claim 13 wherein the high voltage power pulse and trigger pulse means provides alternating power pulses subsequent to the trigger pulses wherein the power pulses have a duration in the range of about 1.0 to 38.5 microseconds.

15. The apparatus of claim 14 further including a flash protection means.

* * * * *

UNITED STATES PATENT AND TRADEMARK OFFICE

CERTIFICATE OF CORRECTION

PATENT NO. : 5,027,034

DATED : June 25, 1991

INVENTOR(S) : Joseph H. Ruby, et al.

It is certified that error appears in the above-identified patent and that said Letters Patent is hereby corrected as shown below:

Column 12, Line 47, delete the word "on" and replace it with -- one --.

Signed and Sealed this

Sixth Day of October, 1992

*Attest:*

DOUGLAS B. COMER

*Attesting Officer*

*Acting Commissioner of Patents and Trademarks*